US005429545A

United States Patent [19]

Meyer

[11] Patent Number: 5,429,545

[45] Date of Patent: Jul. 4, 1995

[54] PAD FOR WETCLEANING PORCELAIN GREENWARE AND METHOD

[76] Inventor: Josephine R. Meyer, 211 W. Harry, Goddard, Kans. 67052

[21] Appl. No.: 113,173

[22] Filed: Aug. 30, 1993

[51] Int. Cl.[6] ..... B24D 11/00

[52] U.S. Cl. ..... 451/523; 451/526; 451/533; 451/539; 51/293

[58] Field of Search ..... 451/523, 526, 532, 533, 451/539; 51/293, 297, 298, 299, 302, 303, 307, 308, 309; 15/208, 210.1, 211

[56] References Cited

U.S. PATENT DOCUMENTS

| | | | |
|---|---|---|---|
| 2,376,783 | 5/1945 | Kingman | 51/400 |
| 2,650,158 | 8/1953 | Eastman | 51/407 |
| 2,804,728 | 9/1957 | Politzer et al. | 51/400 |
| 3,261,675 | 7/1966 | Cameron | 51/400 |
| 4,058,869 | 11/1977 | Wheeler | 15/101 |
| 4,581,287 | 8/1986 | Smith et al. | 51/401 |
| 4,856,134 | 9/1989 | Wertz et al. | 51/407 |
| 5,109,637 | 5/1992 | Calafut | 51/391 |
| 5,140,785 | 8/1992 | Eleouet | 51/401 |
| 5,214,820 | 6/1993 | Shumway et al. | 51/401 |

*Primary Examiner*—Maurina T. Rachuba
*Attorney, Agent, or Firm*—John Wade Carpenter

[57] ABSTRACT

A pad for cleaning porcelain greenware comprising an abrasive sheet for contacting and cleaning porcelain greenware; a foam backing member; and a glue secured to the abrasive sheet and to the foam backing member for securing together the abrasive sheet and the foam backing member. A process or a method for wetcleaning porcelain greenware comprising the steps of: providing a porcelain greenware; providing a container with water; providing the pad; contacting the porcelain greenware and the pad with the water; and sliding the abrasive sheet against the porcelain greenware.

12 Claims, 2 Drawing Sheets

FIG. 1
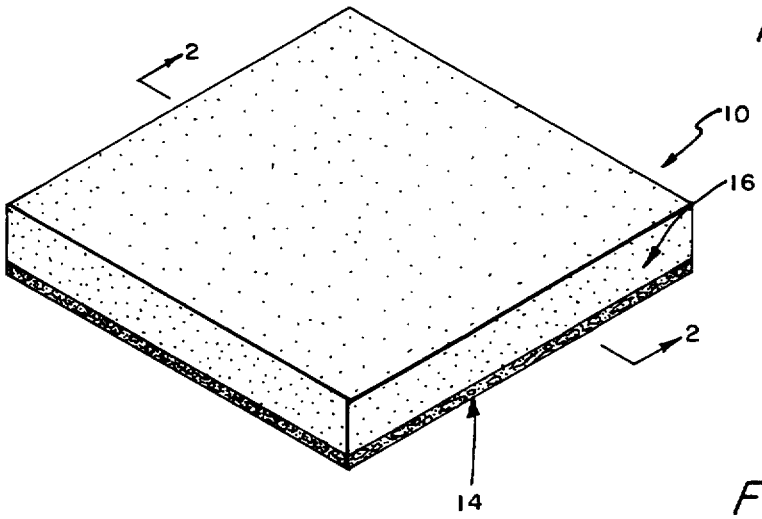
FIG. 2
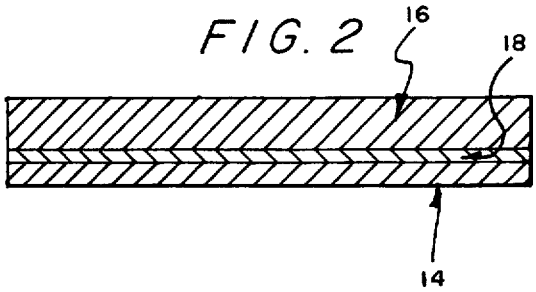
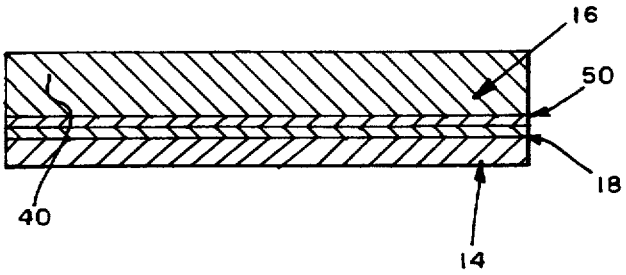
FIG. 4
FIG. 3
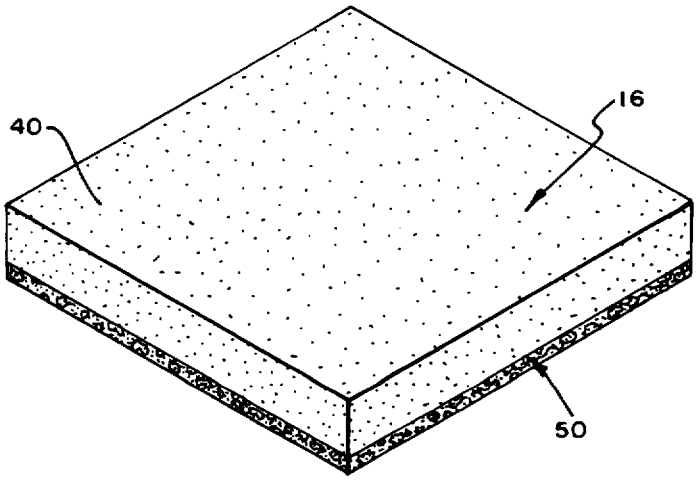

FIG. 5
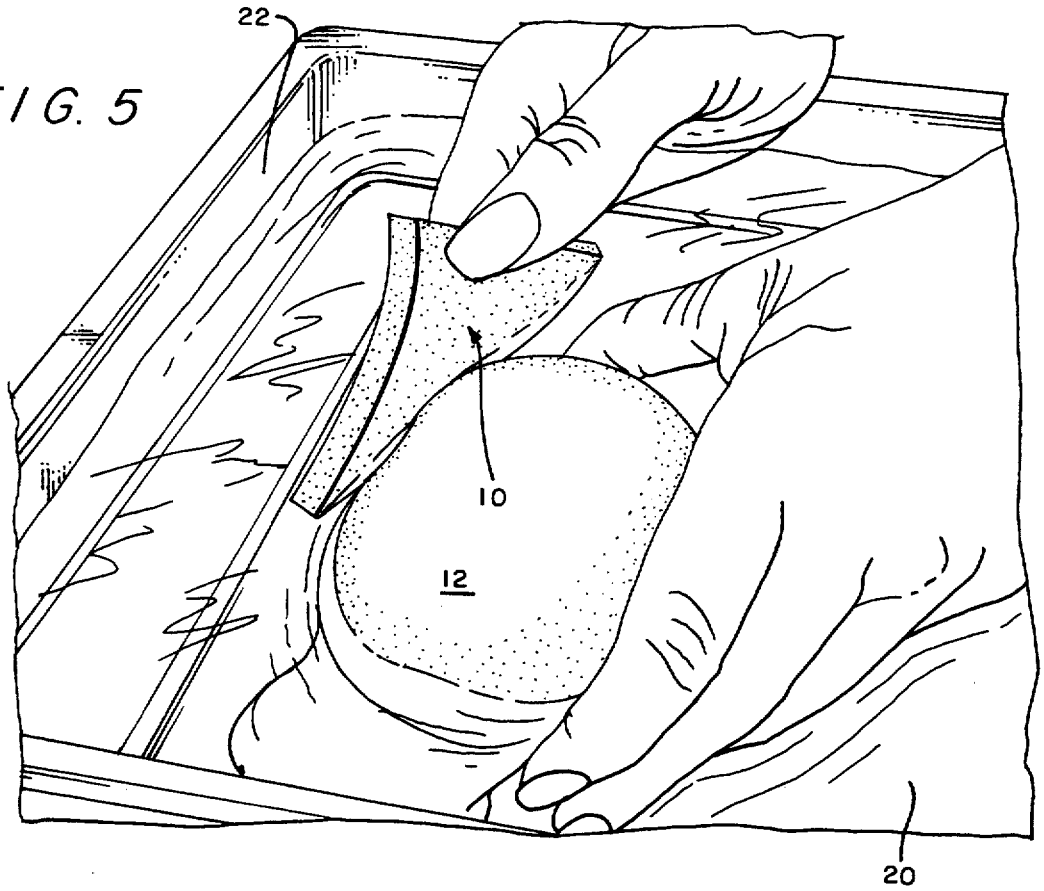
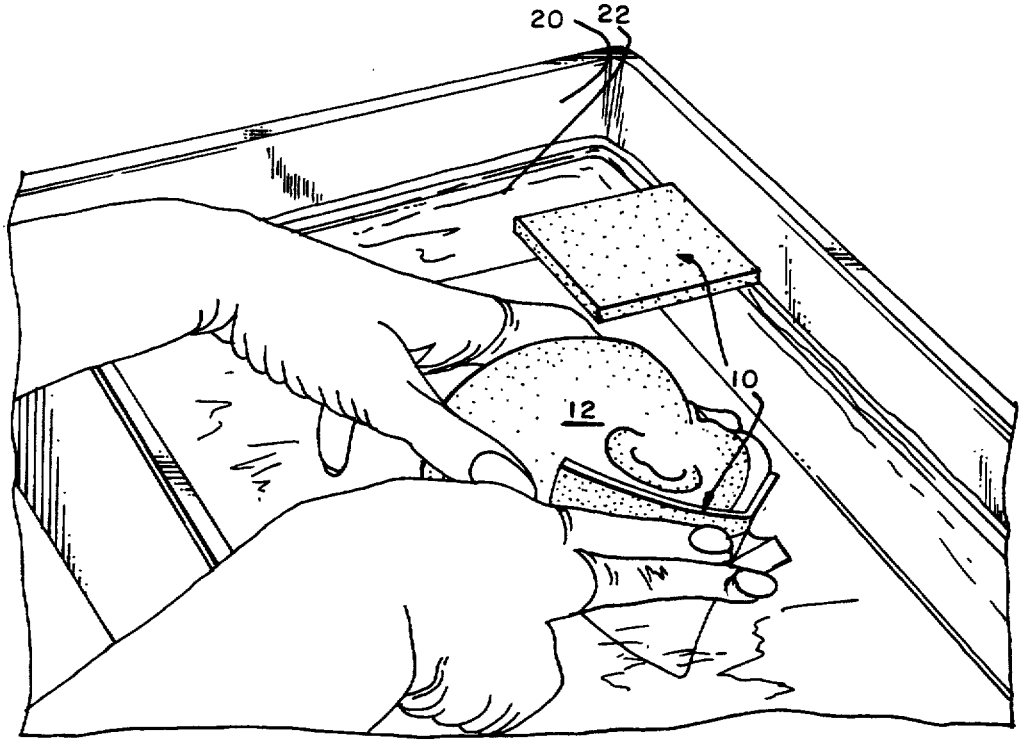
FIG. 6

PAD FOR WETCLEANING PORCELAIN GREENWARE AND METHOD

FIELD OF THE INVENTION

This invention relates to a pad for wetcleaning porcelain greenware. More specifically, the present invention provides a pad and method for wetcleaning porcelain greenware.

DESCRIPTION OF THE PRIOR ART

A patentability investigation was conducted and the following U.S. patent by Nos. were discovered: U.S. Pat. Nos. 3,021,649 to Robbins; 3,099,854 to Goodloe; 4,121,386 to Perez; 4,974,374 to Meyer; 5,007,128 to England et al; and 4,314,426 to Friend. All of these patents are fully incorporated by reference thereto as if repeated verbatim hereafter.

None of the foregoing prior art teaches the particular pad and method of the present invention.

SUMMARY OF THE INVENTION

The present invention accomplishes its desired objects by broadly providing a pad for cleaning porcelain greenware. The pad comprises an abrasive means for contacting and cleaning porcelain greenware; a foam backing member; and a glue secured to the abrasive means and to the foam backing member for securing together the abrasive means and the foam backing member. The glue comprises a vinyl acetate polymer emulsion. The vinyl acetate polymer emulsion comprises from about 1.0% by wt. to about 49.0% by wt. aqueous phase (e.g. water) and from about 51.0% by wt. to about 99.0% by wt. polyvinyl acetate. The vinyl acetate polymer emulsion is water proof when dried. The abrasive means for contacting and cleaning porcelain greenware comprises from about 45.0% by wt. to about 70% by wt. nonwoven fibers, from about 10.0% by wt to about 30% by wt aluminum oxide, and from about 5.0% by wt. to about 15.0% by wt. of an adhesive. The foam backing member comprises a flexible agent selected from a group consisting of polyurethane, rubber latex, polyethylene, vinyl polymers, and mixtures thereof. The foam backing member comprises a density ranging from about 0.2 lb/cu.ft. to about 15.0 lb/cu.ft. The foam backing member more specifically comprises a first backing member and a second backing member bound to the first backing member and to the glue. The first backing member comprises a first flexible agent selected from a group consisting of polyurethane, rubber latex, polyethylene, vinyl polymerse and mixtures thereof, and the second backing member comprises a second flexible agent selected from a group consisting of polyurethane, rubber latex, polyethylene, vinyl polymers, and mixtures thereof. The first backing member comprises a density ranging from about 0.2 lb/cu.ft. to about 8.0 lb/cu.ft., and the second backing member comprises a density ranging from about 8.01 lb/cu.ft. (preferably about 8.0 lb/cu.ft.) to about 15.0 lb/cu.ft.

The present invention further accomplishes its desired objects by further broadly providing a method for wetcleaning porcelain greenware comprising the steps of:

a) providing a porcelain greenware;
b) providing a container with water;
c) providing a pad comprising an abrasive means for contacting and cleaning porcelain greenware; a foam backing member; and a glue secured to the abrasive means and to the foam backing for securing together the abrasive means and the foam backing;
d) contacting the porcelain greenware and the pad with the water; and
e) sliding the abrasive means against the porcelain greenware.

The method additionally comprises inverting the pad and subsequently sliding the foam backing member against the porcelain greenware. As was previously indicated, the glue comprises a vinyl acetate polymer emulsion. The vinyl acetate polymer emulsion comprises about 1.0% by wt. to about 49.0% by wt. aqueous phase and from about 51.0% by wt. to about 99.0% by wt. polyvinyl acetate. The vinyl acetate polymer emulsion is water proof when dried. The abrasive means for contacting and cleaning porcelain greenware comprises from about 45% by wt. to about 70% by wt. nonwoven fibers, from about 10% by wt. to about 30% by wt. aluminum oxide, and from about 5% by wt. to about 15% by wt. of an adhesive. The foam backing member comprises a first backing member and a second backing member bound to the first backing member and to the glue. The first backing member comprises a first flexible agent selected from a group consisting of polyurethane, rubber latex, polyethylene, vinyl polymers, and mixtures thereof, and the second backing member comprises a second flexible agent selected from a group consisting of polyurethane, rubber latex, polyethylene, vinyl polymers and mixtures thereof. The first backing member comprises a density ranging from about 0.2 lb/cu.ft. to about 8.0 lb/cu.ft., and the second backing member comprises a density ranging from about 8.01 lb/cu.ft. to about 15 lb/cu.ft.

It is therefore an object of the present invention to provide a pad for wetcleaning porcelain greenware.

It is another object of the present invention to provide a method for either dry and/or wetcleaning porcelain greenware.

These, together with the various ancillary objects and features which will become apparent to those skilled in the art as the following description proceeds, are attained by this novel pad and method, a preferred embodiment as shown with reference to the accompanying drawings, by way of example only, wherein;

BRIEF DESCRIPTION OF THE DRAWINGS

FIG. 1 is a perspective view of the pad of the present invention;

FIG. 2 is a vertical sectional view taken in direction of the arrows and along the plane of line 2—2 in FIG. 1;

FIG. 3 is a perspective view of another embodiment of the foam backing member;

FIG. 4 is a vertical sectional view of another embodiment of the pad of the present invention;

FIG. 5 is a perspective view of the pad employed to wetclean a porcelain greenware; and FIG. 6 is another perspective view of the pad employed to wetclean a porcelain greenware,

DETAILED DESCRIPTION OF THE PRESENT INVENTION

Referring in detail now to the drawings wherein similar parts of the present invention are identified by like reference numerals, there is seen a pad, generally illustrated as 10, for wetcleaning porcelain greenware, generally illustrated as 12 (see FIGS. 5 and 6).

The pad 10 comprises an abrasive means 14 for contacting and cleaning porcelain greenware 12; a foam backing member 16; and a glue 18 secured to the abrasive means 14 and to the foam backing member 16 for securing and/or bonding together the abrasive means 14 and the foam backing member 16. Typically, the glue 18 would typically be disposed wet on the abrasive means 14 and/or foam backing member 16; and the abrasive means 14 and the foam backing member 16 would be compressed, or otherwise contacted, until the glue 18 is dried. After the glue 18 is dried, the particular glue 18 of this invention (which will be described below) is waterproof which keeps the abrasive means 14 and the foam backing member 16 bound together while the pad 10 is employed with water (aqueous phase) 20 (see FIGS. 5 and 6) in a container 22 for wetcleaning the porcelain greenware 12. Wet cleaning with water 20 is the way to avoid breathing harmful dust. The pad 10 of this invention will not scratch the porcelain greenware 12 when properly employed. The pad 10 may be in rectangular geometric form as depicted in FIGS. 1–6, or the pad 10 may be in strip form as depicted in my U.S. Pat. No. 4,974,374.

The porcelain greenware 12 is fired to a temperature required for wetcleaning, which temperature would vary from about Cone 025 to about Cone 018, depending on locale. After being fired the greenware 12 is placed in lukewarm water, say 70° F. to about 100° F. for 30 secs. to about 10 minutes. Typically about 5 minutes of soaking is all that is necessary before one begins to clean. If the pad 10 is in the form of a strip, the strip should be slightly slack in tool so that it will not create a flat place on the seam(s) of the porcelain greenware 12. The porcelain greenware 12 should be contacted with the abrasive means 14 of the pad 10 in a sliding motion, more particularly a sawing-sliding motion-down a seam of the porcelain greenware 12. Typically from about 2 to about 8 swipes (more typically 3 to 4 swipes is all that is demanded for removing a seam (or evidence of a seam) in the porcelain greenware 12. The pad 10 and the porcelain greenware 12 should be kept very wet at all times; thus the pad 10 should be continually reimmersed in the water 20 and the porcelain greenware 12 should remain in the water 20 (as best shown in FIGS. 5 and 6) with the area of porcelain greenware 12 that is being wiped (or otherwise contacted with the pad 10) above the water 20. The area could remain under water, but it is easier to work on the area if the same is above the water 20 and can be seen.

When the abrasive means 14 has cleaned and/or otherwise removed seams from the porcelain greenware 12, water 20 is squeezed from the pad 10 by pressing the pad 10 against the top (or the peremetrical edges) of the container 22 and subsequently sliding or compressively sliding the pad 10 over and/or against the top or a peremetrical edge of the container 22. The water 20 will typically trickle down an inside wall of the container 22. After or before the water 20 is squeezed from the pad 10, the pad 10 may be inverted such that the foam backing member 16 may be subsequently slid against the porcelain greenware 12 for wiping and/or cleaning the same. There may be some residual porcelain fines on the porcelain greenware 12. It is to be understood that the pad 10 of the present invention may also be employed for dry cleaning (i.e. cleaning without water) the porcelain greenware 12.

The glue 18 of this invention may be any suitable glue 18 which, when applied to the abrasive means 14 and/or to the foam backing member 16 and dries to affix the two together remains waterproof and maintains the abrasive means 14 and the foam backing member 16 in a bounded posture to an extent that they will not separate when wet and/or during frictional contact of the abrasive means 14 and/or the foam backing member 16 with the porcelain greenware 12. Glue 18 is a colloidal suspension of various proteinaceous materials in water. More preferably I have discovered that the glue 18 comprises a vinyl acetate ($CH_3COOCH{:}CH_2$) polymer emulsion. More preferably the vinyl acetate polymer emulsion comprises from about 1.0% by wt. to about 49.0% by wt. aqueous phase (water) and from about 51.0% by wt. to about 99.0% by wt. polyvinyl acetate.

The abrasive means 14 may be any suitable abrasive means (or polishing member) for contacting and cleaning porcelain greenware 12 and producing the desired results. I have discovered that the abrasive means 14 should be a polishing sheet comprising from about 45.0% by wt. to about 70.0% by wt. nonwoven rayon and/or nylon and/or polyester and cellulose, fibers (i.e. a backing); from about 10.0% by wt. to about 30.0% by wt. aluminum oxide (as dust or aluminum in a concentration on the nonwoven fibers (i.e. the backing) of about 10 mg./$m^3$); and from about 5.0% by wt. to about 15.0% by wt. of a cured polyester adhesive. The abrasive means 14 may also possess any of chemical and/or physical characteristics in the following Table:

| MICRON GRADE | U.S. MESH |
|---|---|
| 30 | 400 |
| 15 | 600 |
| 9 | 1200 |
| 3 | 4000 |
| 2 | 6000 |
| 1 | 8000 |

Thus, the abrasive means 14 (or polishing sheet) may comprise a micron grade ranging from about 30 to about 1 and/or a U.S. mesh ranging from about 400 to about 8000.

The foam backing member 16 may be any suitable foam that is capable of combining with the glue 18 and the abrasive means 14 (or abrasive member 14 or sheet) to produce the desired effects of the present invention. The foam backing member 16 preferably comprises a flexible agent selected from a group consisting of polyurethane, rubber latex, polyethylene, vinyl polymers, and mixtures thereof; and further comprises a density ranging from about 0.2 lb/cu.ft. to about 15 lb/cu.ft. In another embodiment of the foam backing member 16 as depicted in FIGS. 3 and 4, the foam backing member 16 comprises a first foam backing member 40 having a density ranging from about 0.2 lb/cu.ft. to about 8.0 lb/cu.ft., and a second foam backing member 50 integrally formed with the first foam backing member 40 and including a density ranging from about 8.0 (or 8.01) lb/cu.ft. to about 15.0 lb/cu.ft. The second foam backing member 50 may be likened to a crust formed on a loaf of bread. The first foam backing member 40 typically has a height ranging from about ⅛ inch to about 0.5 inch and the second foam backing member 50 has a height ranging from about 1/64 inch to about ⅛ inch.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A pad for wet cleaning porcelain greenware comprising an abrasive means for contacting and cleaning porcelain greenware; a foam backing member; and a glue being a colloidal suspension of proteinaceous materials in water and secured to said abrasive means and to said foam backing member for securing together the abrasive means and the foam backing member; said glue comprises a vinyl acetate polymer emulsion; said vinyl acetate polymer emulsion comprises from about 10% by wt. to about 49.0% by wt. aqueous phase and from about 51.0% by wt. to about 99.0% by wt. polyvinyl acetate; and said vinyl acetate polymer emulsion is waterproof when dried; said abrasive means for contacting and cleaning porcelain greenware comprises from about 45.0% by wt. to about 70% by wt. nonwoven fibers, from about 10.0% by wt. to about 30% by. wt. aluminum oxide, and from about 5.0% by wt. to about 15.0% by wt. of an adhesive; said foam backing member comprises a flexible agent selected from a consisting of polyurethane, rubber latex, polyethylene, vinyl polymers, and mixtures thereof; said foam backing member comprises a density ranging from about 0.2 lb/cu.ft. to about 15.0 lb/cu.ft.

2. The pad of claim 1 wherein said foam backing member comprises a first backing member and a second backing member bound to said first backing member and to said glue.

3. The pad of claim 2 wherein said first backing member comprises a first flexible agent selected from a group consisting of polyurethane, rubber latex, polyethylene, vinyl polymers, and mixtures thereof, and said second backing member comprises a second flexible agent selected from a group consisting of polyurethane, rubber latex, polyethylene, vinyl polymers, and mixtures thereof.

4. The pad of claim 3 wherein said first backing member comprises a density ranging from about 0.2 lb/cu.ft. to about 8.0 lb/cu.ft., and said second backing member comprises a density ranging from about 8.01 lb/cu.ft. to about 15.0 lb/cu.ft.

5. The pad of claim 1 wherein said foam backing member comprises a first backing member and a second backing member bound to said first backing member and to said glue.

6. The pad of claim 5 wherein said first backing member comprises a first flexible agent selected from a group consisting of polyurethane, rubber latex, polyethylene, vinyl polymers, and mixtures thereof, and said second backing member comprises a second flexible agent selected from a group consisting of polyurethane, rubber latex, polyethylene, vinyl polymers, and mixtures thereof.

7. The pad of claim 6 wherein said first backing member comprises a density ranging from about 0.2 lb/cu.ft. to about 8.0 lb/cu. ft., and said second backing member comprises a density ranging from about 8.01 lb/cu.ft. to about 15.0 lb/cu.ft.

8. The pad of claim 7 wherein said pad includes being wetted with water such that water is retained by at least one of said first backing member and said second backing member and being adaptable for wetcleaning porcelain greenware which has been wetted with water.

9. A pad for wet cleaning porcelain greenware comprising an abrasive means for contacting and cleaning porcelain greenware; a foam backing member; and a glue being a colloidal suspension of proteinaceous materials in water and secured to said abrasive means and to said foam backing member for securing together the abrasive means and the foam backing member; said glue comprises a vinyl acetate polymer emulsion; said vinyl acetate polymer emulsion comprises from about 1.0% by wt. to about 49.0% by wt. aqueous phase and from about 51.0% by wt. to about 99.0% by wt. polyvinyl acetate; and said vinyl acetate polymer emulsion is water proof when dried; said abrasive means for contacting and cleaning porcelain greenware comprises from about 45.0% by wt. to about 70% by wt. nonwoven fibers, from about 10.0% by wt. to about 30% by wt. aluminum oxide, and from about 5.0% by wt. to about 15.0% by wt. of an adhesive; said foam backing member comprises a flexible agent selected from a group consisting of polyurethane, rubber latex, polyethylene, vinyl polymers, and mixtures thereof.

10. The pad of claim 9 wherein said foam backing member comprises a first backing member and a second backing member bound to said first backing member and to said glue.

11. The pad of claim 10 wherein said first backing member comprises a first flexible agent selected from a group consisting of polyurethane, rubber latex, polyethylene, vinyl polymers, and mixtures thereof, and said second backing member comprises a second flexible agent selected from a group consisting of polyurethane, rubber latex, polyethylene, vinyl polymers, and mixtures thereof.

12. The pad of claim 11 wherein said first backing member comprises a density ranging from about 0.2 lb/cu.ft. to about 8.0 lb/cu.ft., and said second backing member comprises a density ranging from about 8.01 lb/cu.ft. to about 15.0 lb/cu.ft.

* * * * *